US012428193B2

(12) United States Patent
Henriksen

(10) Patent No.: US 12,428,193 B2
(45) **Date of Patent: *Sep. 30, 2025**

(54) PACKED ROOF WINDOW PRODUCTS

(71) Applicant: VKR Holding A/S, Hørsholm (DK)

(72) Inventor: Jens-Ulrik Holst Henriksen, Aarhus (DK)

(73) Assignee: VKR Holding A/S (DK)

( * ) Notice: Subject to any disclaimer, the term of this patent is extended or adjusted under 35 U.S.C. 154(b) by 0 days.

This patent is subject to a terminal disclaimer.

(21) Appl. No.: 18/699,288

(22) PCT Filed: Oct. 7, 2022

(86) PCT No.: PCT/DK2022/050209

§ 371 (c)(1),
(2) Date: Apr. 7, 2024

(87) PCT Pub. No.: WO2023/057030

PCT Pub. Date: Apr. 13, 2023

(65) Prior Publication Data

US 2024/0425232 A1 Dec. 26, 2024

(30) Foreign Application Priority Data

Oct. 8, 2021 (DK) ..... PA 2021 70502

(51) Int. Cl.

| | |
|---|---|
| ***B65D 5/50*** | (2006.01) |
| ***B65D 5/20*** | (2006.01) |
| ***B65D 5/30*** | (2006.01) |
| ***B65D 85/00*** | (2006.01) |

(52) U.S. Cl.

CPC ..... *B65D 5/5021* (2013.01); *B65D 5/2052* (2013.01); *B65D 5/30* (2013.01); *B65D 85/54* (2013.01)

(58) Field of Classification Search

CPC ..... B65D 5/5021; B65D 5/2052; B65D 5/30; B65D 85/54; B65D 85/48

USPC ..... 206/321, 325

See application file for complete search history.

(56) References Cited

U.S. PATENT DOCUMENTS

| | | | | |
|---|---|---|---|---|
| 2,008,875 | A | 7/1935 | Peterson et al. | |
| 6,189,777 | B1 | 2/2001 | Hutchinson et al. | |
| 2008/0148692 | A1 * | 6/2008 | Wisecarver | B65D 5/5069 53/462 |
| 2014/0263595 | A1 | 9/2014 | Pantelleria | |
| 2019/0002154 | A1 * | 1/2019 | Hugley | B65D 5/0254 |

(Continued)

FOREIGN PATENT DOCUMENTS

| | | | | |
|---|---|---|---|---|
| EP | 1710163 | | 10/2006 | |
| EP | 1710163 | A1 * | 10/2006 | B65D 5/5054 |
| EP | 2748071 | | 4/2013 | |

(Continued)

OTHER PUBLICATIONS

U.S. Appl. No. 18/699,289, filed Apr. 7, 2024.

(Continued)

*Primary Examiner* — Rafael A Ortiz

(74) *Attorney, Agent, or Firm* — Merek, Blackmon & Voorhees, LLC

(57) ABSTRACT

A packed roof window product wherein a plurality of diferently sized window product related components are packed in a box and one of the components is carried by a side wall of the box.

19 Claims, 12 Drawing Sheets

(56) References Cited

U.S. PATENT DOCUMENTS

| | | | | |
|---|---|---|---|---|
| 2022/0371771 | A1* | 11/2022 | Ghini | B65D 5/244 |
| 2024/0425258 | A1* | 12/2024 | Tollak | B65B 5/10 |

FOREIGN PATENT DOCUMENTS

| | | |
|---|---|---|
| WO | WO2013050041 | 4/2013 |
| WO | WO2014096146 | 6/2014 |
| WO | WO2021180288 | 9/2021 |

OTHER PUBLICATIONS

U.S. Appl. No. 18/699,285, filed Apr. 7, 2024.
International Search Report dated Dec. 19, 2022 issued in connection with International Application No. PCT/DK2022/050209, two (2) pages.
Non-Final Rejection dated May 14, 2025 issued in U.S. Appl. No. 18/699,285, eight (8) pages.

* cited by examiner

PACKED ROOF WINDOW PRODUCTS

TECHNICAL FIELD

A packed roof window product comprising a plurality of differently sized roof window related product components accommodated in a box, wherein the box in a supply condition has a bottom side and a top side, which bottom side and top side are spaced apart along a height axis, and side walls of the box extend between the bottom side and top side of the box in the height axis, said bottom side, top side and side walls delimiting an internal space of the box, and wherein a first side wall extends along a primary axis, which primary axis is perpendicular to the height axis, and said first side wall has an upper edge extending along the primary axis along the top side and an outer surface facing away from the internal space.

BACKGROUND ART

When installing windows in a roof it is vital to ensure that the roof window itself is securely attached to the roof structure and that the joint between the roof window and the roof structure is properly weather proofed. It is therefore important that all components of roof window products, such as the roof window itself or a flashing assembly for a roof window, are used and are used in the right way. To facilitate this, the components are typically arranged in the box in an intended order of use and small components, such as screws, are kept in plastic bags. Furthermore, blocks of expanded polystyrene or similar shock absorbing material are used for protecting the product and/or for keeping the components in the intended position within the box. An example of a packed roof window, where these principles are used, is known from EP2748071B1 and an example of a packed flashing assembly for a roof window is known from EP1710163B1. Traditionally small components have been attached to the box or to larger components, for example by means of an adhesive, to prevent them from becoming lost, either inside the box or when removed from the box, and/or they have been wrapped in plastic, thereby also preventing them from scratching or otherwise damaging other components. Larger components have traditionally been kept in place in the box by being attached to the box by means of an adhesive or by being fixated between blocks of expanded polystyrene (EPS), and some have been covered by a protective plastic film to prevent them from being scratched.

However, combined with an ever-increasing awareness of environmental considerations and the wish to reduce or even eliminate the climate footprint of products and their packaging, there is a need for delivering packed products that are more environmentally friendly.

SUMMARY OF INVENTION

With this background, it is an object of the invention to provide a packed roof window product, which has a smaller climate footprint and/or with improved recyclability, without increasing the risk of errors in the installation of the product and maintaining a good protection of the components of the product during handling and transportation.

These and further objects are achieved with a packed roof window product of the kind mentioned in the introduction, which is furthermore characterised in that a first of said components is carried by the first side wall.

By providing a packed roof window product wherein the first component is carried by the side wall, it may be possible to reduce the size of the box by employing previously unused space in the box, leading to reduced material consumption and climate footprint. As packed roof window products contain components of different sizes, including large components, such as insulation frames, and smaller components, such as collections of screws, the minimum dimensions of the box are determined at least in part by the largest dimensions among the components. Furthermore, as some components are fragile, they must be kept secure and apart in the packaging, making stacking of such components impractical without the use further protective packaging material or fastening means. Hence one component typically determines the height of the box along the height axis, leaving unused space in the box above other components of lesser height. By having the first component be carried by the side wall, the height dimension of the box may be used to a greater extent, allowing e.g. the width of the box to be reduced. Hence the material consumption can be reduced leading to a smaller climate footprint and potentially also to more flexibility in handling, storage, and transportation. Further, as the first component is carried by the side wall, auxiliary fastening means such as adhesives, tape or straps, may be eliminated, potentially rendering the packaging more suitable for easy recycling. It is presently preferred that the box is made from a paper-based material, such as cardboard, more preferably corrugated cardboard, all of which are is readily recyclable.

A further potential advantage may be that the strength and/or rigidity of the packed roof window product may be improved by the component serving as a reinforcement. This may especially be the case if the first component is a long component extending along a majority of the length of the side wall.

It is understood that the first component is carried by the first side wall without the use of fastening means beyond the box itself, such as straps, tape or adhesives, i.e. it may hang from or be suspended from the first side wall. The component may be said to the freely suspended from the first side wall. Hence, the first component is carried by the first wall by way of engagement between the first component and the side wall and possibly further panels of the box, such as a lid of the box when the box is closed. The first component may generally be carried by the first side wall by a part of the first component extending across the side wall.

The box may be of a rectangular configuration where the top side and bottom side extend in parallel and four side walls extend perpendicularly in between the bottom and top sides. In such a case the height axis is parallel with the side walls and two side walls extend along the primary axis and the remaining two side walls extend along a secondary axis, which is perpendicular both to the height axis and to the primary axis. The primary and secondary axis may be denoted a longitudinal axis and a transverse axis, respectively. While the first side wall of the box which carries the first component, is generally described herein as defining the length of the box, it is also possible for the first side wall to be shorter than the sidewalls extending in the secondary axis, whereby the first side wall may be said to define the width of the box, and thus for the first component to be carried by the shorter among the side walls.

The box may be a flat box, wherein the top side and bottom side form major sides of the box and the side wall are minor sides. Major and minor here refers to the area of the side. In flat boxes a height of the box is smaller than the other dimensions, i.e. length and width.

The term supply condition denotes the packed state of the roof window product, in which it is supplied to the user. The box is described herein with reference to a bottom side and a top side with side walls extending in between. These terms are understood in terms of their function when packing the roof window product, the top side being the side which is open when packing the roof window product, allowing components to be packed in the box, and subsequently the top side is closed to provide the supply condition. The top side may also be denoted a lid of the box. The surfaces the box which face the internal space of the box in the supply condition are denoted as inner surfaces or faces, whereas surfaces or faces facing away from the internal space will be denoted as outer surfaces or faces.

The packed roof window product comprises a plurality of roof window related product components, and the first component is carried by the side wall, while at least some of, preferably a majority of, the other components are placed on the bottom side of the box, either directly or resting on top of one or more other components. Some of the other components may be glued to the bottom side or kept in place by positioning elements.

The packed roof window product may comprise additional components carried by the first or other side walls of the box.

In some embodiments the first component is suspended from the upper edge of the first side wall. The first component can be suspended from the upper edge by a part of the first component resting on the upper edge.

By having the first component rest on the upper edge it is suspended from the side wall providing a position toward the top side of the box in the supply condition. In addition, when the box is closed in the supply condition, the lid of the box will be in contact with the first component, preventing the first component from sliding along the side wall by increasing friction. In this way the first component is effectively fixed in the box without the use of auxiliary fastening means, beyond the box itself, reducing the amount of packaging material used.

The upper edge is a free upper edge of a panel of the box forming the side wall. The edge may the formed by a fold between two panels of the box or alternatively by being the extremity of the panel. The term "upper" denotes a position upwards along the height axis, i.e. toward the top side of the box. The first component may be suspended from the upper edge by extending along and engaging the upper edge thereby resting on the upper edge of the side wall.

In some embodiments, the first side wall comprises a receiving section, and the first component is carried by the receiving section.

The receiving section is a part of the side wall which has been modified e.g. by cutting and/or deformation, such that the first component can be carried therefrom, e.g. by being suspended from the receiving section. While it may be sufficient for some components to be carried by the side wall by resting on the upper edge, the attachment of the component to the side wall may be improved by providing a receiving section in the side wall, configured for receiving the first component. Boxes of a paper-based material such as corrugated cardboard are suitable for such embodiments as the material is easily cut or compressed to provide the receiving section, and cuts for the receiving section or perforations can be made at the same time as the cardboard box blank is cut.

In some embodiments, the receiving section comprises a recess in the upper edge of the first side wall.

The recess is formed in the upper edge such that the side wall has a non-uniform height. By providing a recess in the side wall the first component can be arranged in a retracted position in relation to top side of the box, allowing the box to close in a flush manner. Furthermore, the first component can be arranged in between ends of the recess, which ends keeps the first component in place, preventing it from sliding along the side wall in the direction of the primary axis. In such an embodiment the recess has a length corresponding substantially to a length of the first component.

In some embodiments, the receiving section comprises an aperture in the first side wall. The aperture is an opening in the side wall, the edge of which opening is delimited by the first side wall, i.e. it has no free edges. By providing an aperture a part of the first component can extend through the aperture allowing it to be carried by or suspended from the side wall. The aperture may extend along the primary axis, defining a support section of the first side wall between the upper edge and the aperture, wherein the first component is carried by from the support section. Such a support section is attached to the remainder of the side wall at longitudinal ends of the support section, as seen along the primary axis. The supporting section is possibly flexible and can be retracted slightly into the box, providing a retracted position of the first component, which can facilitate attachment of the lid of the box.

In some embodiments, the first component is elongate, having a component length extending between longitudinal ends of the first component, and the first component is carried by the side wall by being suspended at its longitudinal ends.

In such an embodiment the first component extends along the first side wall along the primary axis and is supported at its longitudinal ends by the first side wall thereby suspending the first component, while an intermediate part of the first component is free, the intermediate part extending between the supported longitudinal ends. This allows the intermediate part to extend along the inner side of the first side wall, reducing the area of a first part of the first component which is positioned at the outer surface of the first side wall. Minimizing the first part, can facilitate fastening of box lid and may protect the more fragile portions of the component, if any. This may be achieved e.g. by flaps or spaced apart recesses/cuts in the side wall. Being suspended from its longitudinal ends may also prevent the first component from sliding along the side wall in the direction of the primary axis.

The term "first part" here denotes one or more parts of the first component which is positioned on the outer surface of the first side wall.

In some embodiments, the receiving section comprises at least two flaps, and the first component is carried by the first side wall by being suspended from these two flaps at the longitudinal ends of the first component.

The flaps may be hinged in a manner allowing movement about the height axis. Such flaps can be inserted into openings or recesses at the longitudinal ends of the first component, thereby suspending the first component from the flaps of the side wall. The flaps may project in opposite directions along the primary axis. The flaps may be cut from a panel forming the first side wall and bends in the material of the box serves as hinges. In an alternative embodiment, a component having suitable openings or recess, which are not located at the ends of the component, is suspended by inserting flaps into such openings or recesses.

In some embodiments, the receiving section comprises at least two cuts in the first side wall from the upper edge, which two cuts are spaced apart along the primary axis. The two cuts form two end sections of the side wall between the ends of the side wall end the respective cuts, and an intermediate section is formed between the two cuts. The first component can then be suspended at the two end sections, while it is not suspended from the intermediate section. In this way the area of the first part, i.e. the parts of the first component positioned at the outer surface of the first side wall, will be minimized. The cuts can be simple straight cut lines in the side wall or have more complex shapes. In addition, or as an alternative to providing end sections from which the first component can be suspended, the cuts may carry the first component by supporting a lower edge of the first component.

The receiving section may comprise more than two of the flaps or cuts described above. For example, having three cuts may allow the same box to be used for different roof window products, allowing components of different length to be carried by the side wall by using the two cuts furthest from each other for a longer component and using the two cuts closest to each other for a shorter component.

The receiving section can combine several of the modifications described herein. For example, the receiving section can comprise flaps which also form recesses in the side wall, thus both providing a small first part of the first component, which is retracted in relation to the top side, and possibly where the recess ends prevent the component from sliding on the flaps. Similarly, cuts can be combined with a recess.

In some embodiments, the top side of the box is formed by a lid of the box, and the lid comprises an overlap panel, which overlap panel overlaps an outer side of the first side wall in the supply condition so that the first part of the first component is located between the first side wall and the overlap panel.

In this way the first part of the first component is covered by the overlap panel and friction between the overlap panel and the component will reduce the tendency of the component to slide on the first side wall. The first part may be said to sandwiched between the first side wall and overlap panel. The overlap panel may be a flap in the case of a 5-panel folder type cardboard box, or it may be a lid side wall in the case of telescope style cardboard box. In the closed state of the box the overlap panel may be fastened to the side wall, preferably by an adhesive.

A five-panel fold type box (sometimes referred to as five-panel-folder) is a standard box type, where fifth panel is provided to overlap with another panel in the closed state of the box. Telescopic boxes are also a standard box type, wherein the box comprises two pieces, which can be fitted to each other such that side walls of one piece are at least partly overlapped by side walls of the other piece.

In a further development, the overlap panel and/or the first side wall is provided with a zone of reduced thickness, such as a compressed zone, and this zone corresponds in size and shape at least to the first part of the first component. Typically, such overlap panel are attached to the outer surface of the side wall with which it is overlapping using adhesive to close the box as described above. However, as the first part is present on the outer surface, it may prevent the overlap panel from resting flush against outer surface and thus prevent the adhesive from attaching properly or breaking the adhesive connection by pressing the overlap panel away from the side wall. However, by reducing the thickness of the overlap panel or the side wall in the area of the first part, the contact between the outer surface and the overlap panel and in turn attachment is improved. For corrugated cardboard boxes the reduced thickness may be provided by compression of the corrugated cardboard.

In some embodiments, the first side wall of the box comprises an inwardly projecting panel projecting into the internal space of the box, and the first component is suspended from the inwardly projecting panel.

The panel preferably projects into the internal space of the cardboard box from the upper edge of the panel forming the first side wall. The panel may comprise an aperture and the first component being suspended from the aperture. Alternatively, or additionally the inwardly projecting panel may be provided with flaps from which the first component is suspended.

In some embodiments, the first component is a gutter-shaped component of a covering assembly or a flashing assembly for a roof window. Gutter-shaped components are typically used to drain off water, for example along the top of a roof window installed in an inclined roof, where a gutter drains water out onto one or more side flashing members extending along the side(s) of the window. The gutter-shaped component has a U-shaped cross-section formed by respective legs of the component, which allows it to be suspended from the side wall. Other components having projecting legs may be suspended from these legs. Another component which may be suspended from the side wall is a cover member of a covering assembly.

In some embodiments, the first side wall has a length L along the primary axis and the first component extends over 20 to 90% of the length L, preferably over 50 to 90% of the length L.

In some embodiments, the cardboard box is folded from one or more blanks, preferably a blank of the five-panel fold type or a blank of the telescopic type.

The roof window product may be an installation kit for use in the installation of a roof window system, such as a kit comprising flashing members and insulating members and possibly also an underroof collar.

Other embodiments and further advantages will be apparent from the subsequent detailed description and drawings.

BRIEF DESCRIPTION OF DRAWINGS

In the following, embodiments of the invention will be described with reference to the schematic drawings in which.

DESCRIPTION OF EMBODIMENTS

Figure 1:
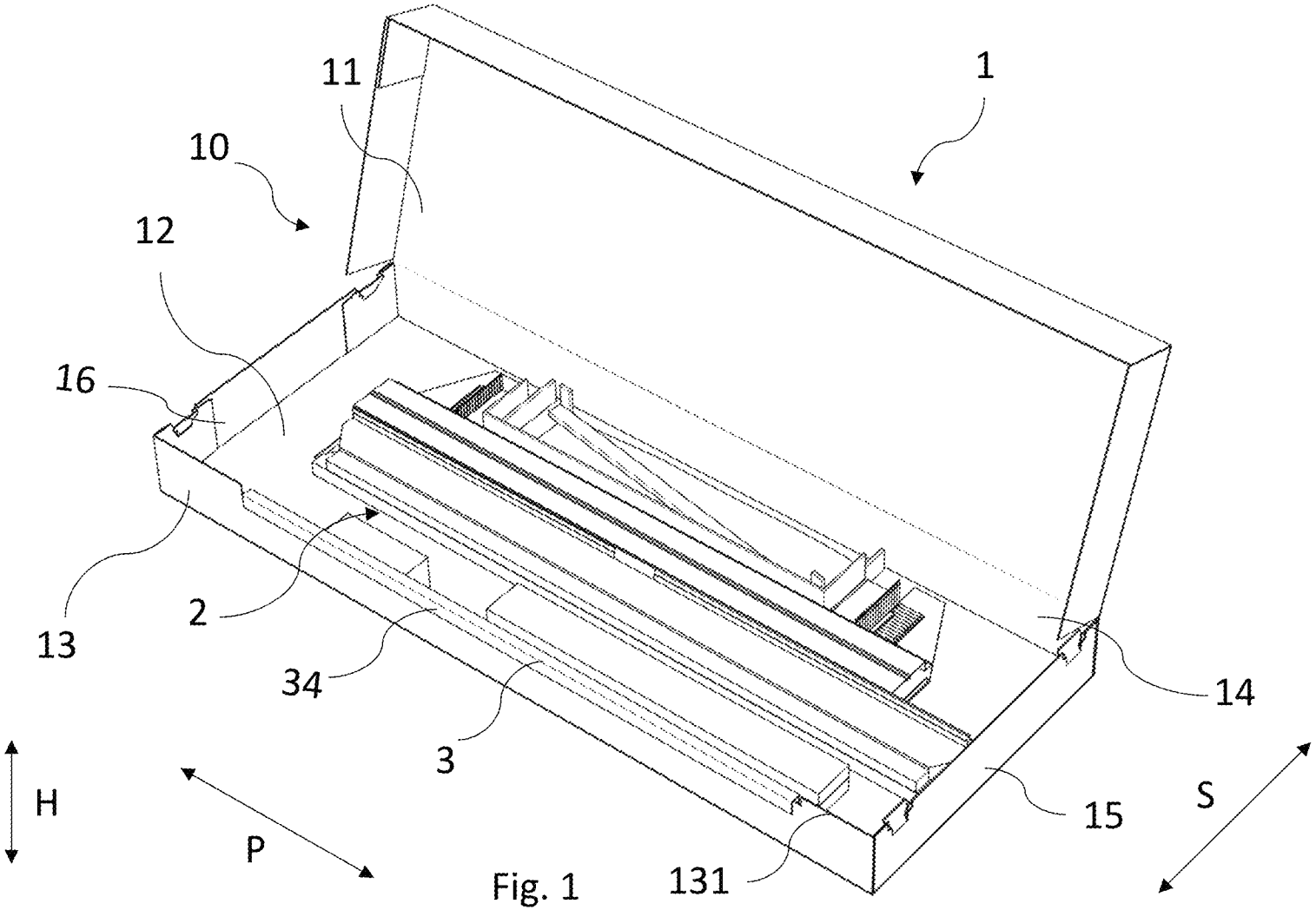
FIG. 1 is a perspective view from above of a cardboard box with an open lid accommodating a roof window product embodied by an installation kit.

Referring initially to FIG. 1 which shows a perspective view from above of a packed roof window product 1 packed in a box 10, said box being of cardboard and of the five-panel fold type. The cardboard box is shown in an open state where a lid forming the top side 11 in the closed state, is open. The box 10 has a rectangular configuration and has a bottom side 12 and a four side walls 13-16 which side walls extend along a height axis H which is perpendicular to the bottom side 12. A first of the side walls 13 extends between side walls 15-16 along a primary axis P. Side walls 15-16 extend along a secondary axis S, the primary and secondary axis being perpendicular to the heigh axis and mutually perpendicular. The primary axis is longitudinal, and the secondary axis is transverse. The box 10 has an internal space which accommodates a plurality of window product related components 2. The components 2 include a flashing assembly and insulation frame side members, and a gutter element 3. The gutter element 3 embodies the first component and is carried by the first wall 13. The gutter element 3 is suspended from the first side wall 13 by being suspended from the upper edge 131 of the first side wall. The gutter element 3 has a U-shaped cross-section allowing it to be suspended on the first wall with one leg of the gutter element 3 extending along the outer surface of the first side wall, which leg is thus denoted the first part 34 of the gutter element 3, and another leg (not shown) extending along the inner surface 132 of the first side wall. (The inner surface of the first side wall and the leg of the gutter element 3 extending along it is not visible in FIG. 1) In the embodiment shown, the gutter element 3 extends about 75% of the length of the first side wall 13 (see length L in FIG. 2).

In the supply condition the lid 11 is closed and in contact with the gutter element 3. In this way the gutter element 3 kept in place in the box 10, without the use of auxiliary fastening means.

Figure 2:
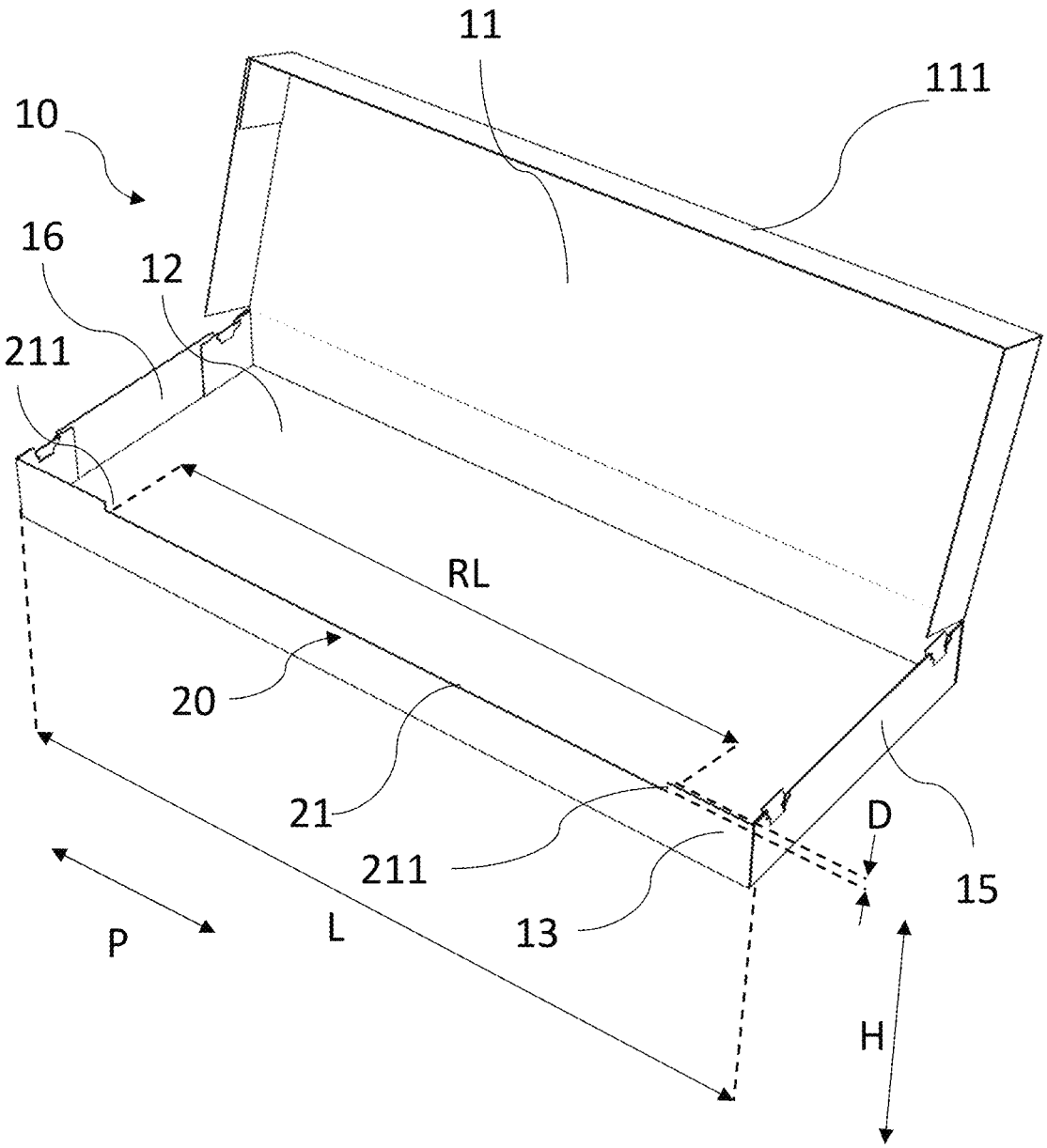
FIG. 2 shows a perspective view from the side of a box having a recess in the side wall as a receiving section.

Referring now to FIG. 2 which shows a box 10 with a receiving section 20. The window product related components are not shown. The box 10 is similar to the one in FIG. 1, but the first side wall 13 has been provided with a recess 21 to form the receiving section 20 for a first component. The first side wall 13 has length L along the primary axis, extending between the side walls 15 and 16. The lid 11 of the box is shown with three overlap panels 111 which are configured for overlapping with three of the side walls in the supply condition, where the lid is closed, and it is to be understood that such overlap panels are also found on the box in FIG. 1. The receiving section 20 is a central portion of the first side wall 13 with reduced height along the height axis H and which is delimited along the primary axis P by recess ends 211. When packing the first component, it is placed on the upper edge of the recess in between the recess ends 211. The recess length RL is configured to keep the first component from sliding along the recess. Similarly, the recess depth D can be configured such that the first component is substantially flush with the upper edge of the first side wall 13 when it is suspended from the recess 21, allowing the lid 11 to fit to the first side wall 13 in the closed position without bulging.

Figure 3:
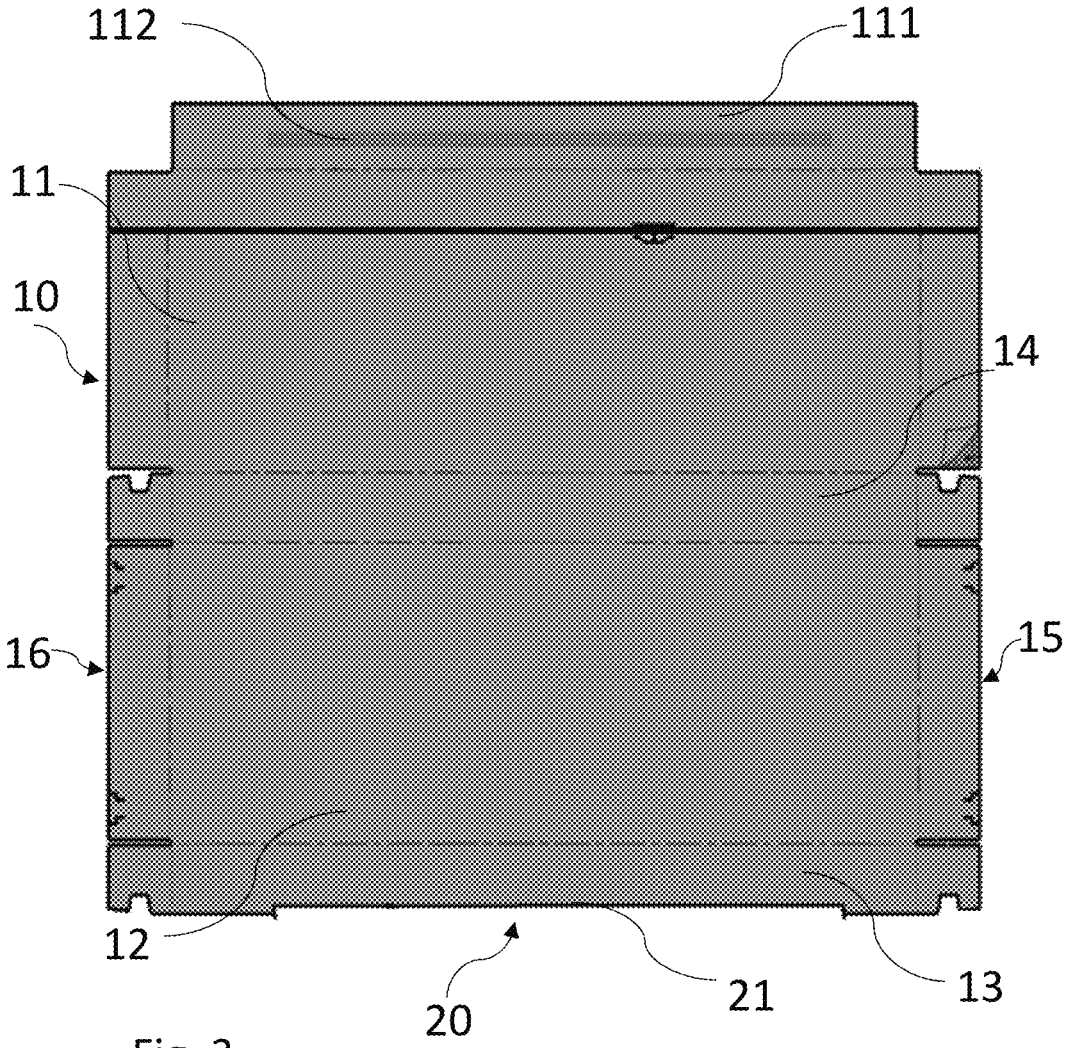
FIG. 3 shows a five-panel fold type blank for a box as in FIG. 2.
Figure 4:
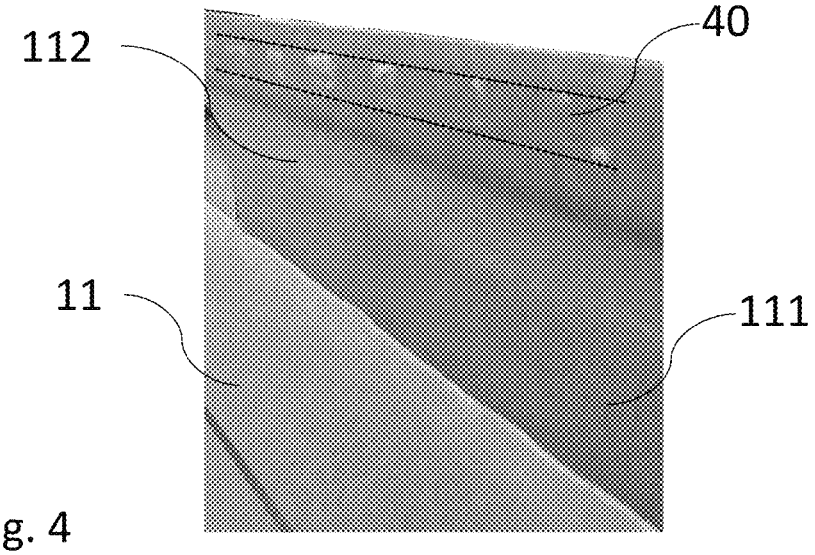
FIG. 4 shows details of the lid of a box.

Referring now to FIG. 3 which is a blank of the five-panel fold type for a box as shown in FIG. 2. This blank is for a box where the side walls are formed by panels designed to interlock in the folded state. In alternative designs the box is glued in the folded state. The overlap panel 111 is provided with a zone of reduced thickness 112 which provides space for the first component when the overlap panel 111 is attached to the first side wall 13 at the recess 21. Further details of the zone of reduced thickness 112 are shown in FIG. 4, which furthermore shows a string of glue 40 indicated by dashed lines. The string of glue 40 is provided on the overlap panel 111 above the zone 112. In the closed state the overlap panel will face in the opposite direction so that the string of glue 40 will be below the zone 112, closest to the bottom side of the box. Without the zone 112 the first component could tend to push the overlap panel 111 away from the first side wall 13, thus inhibiting efficiency of the glue.

Figure 5:
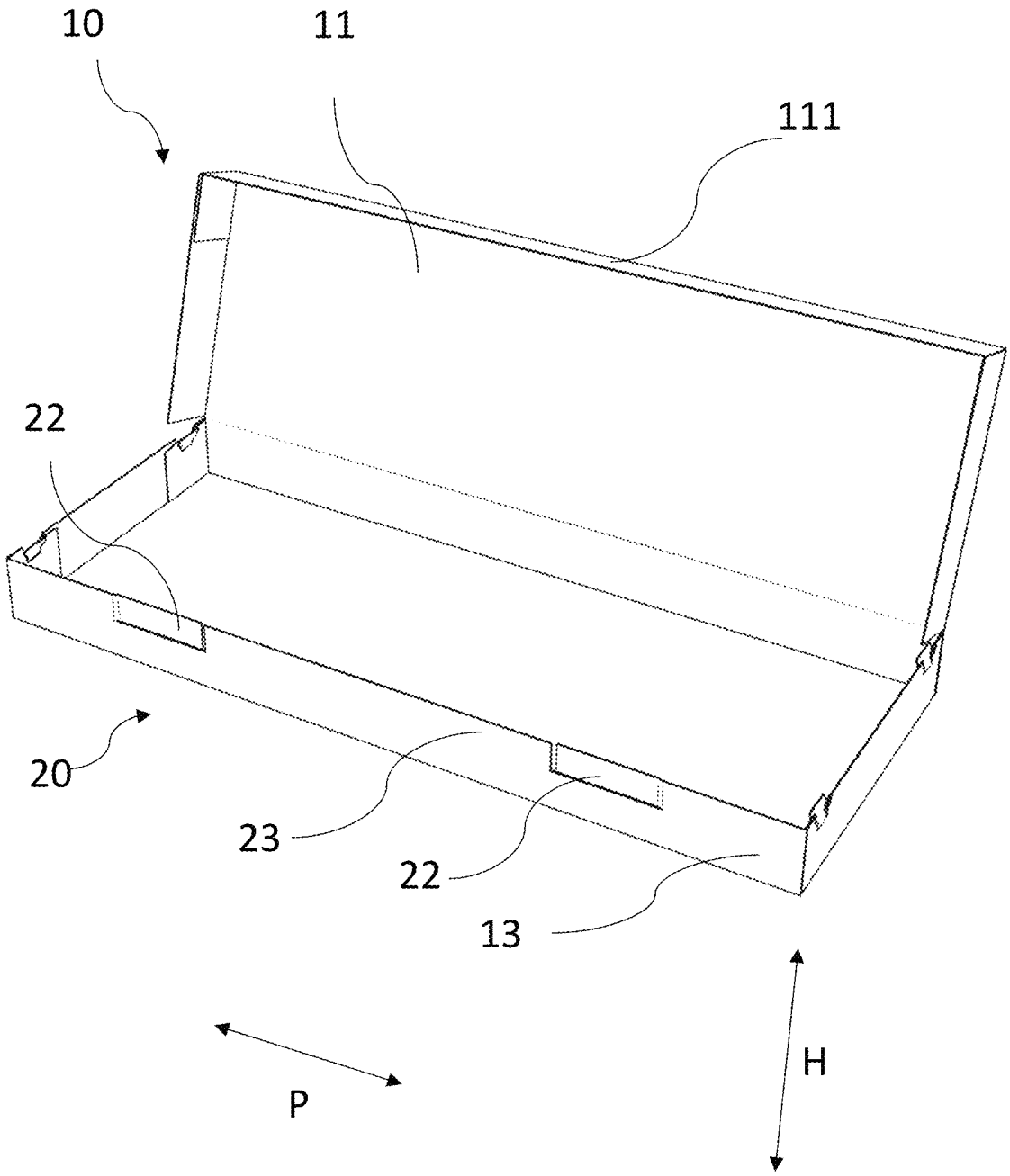
FIG. 5 shows a perspective view from the side of a box having two flaps in the side wall a receiving section.
Figure 6:
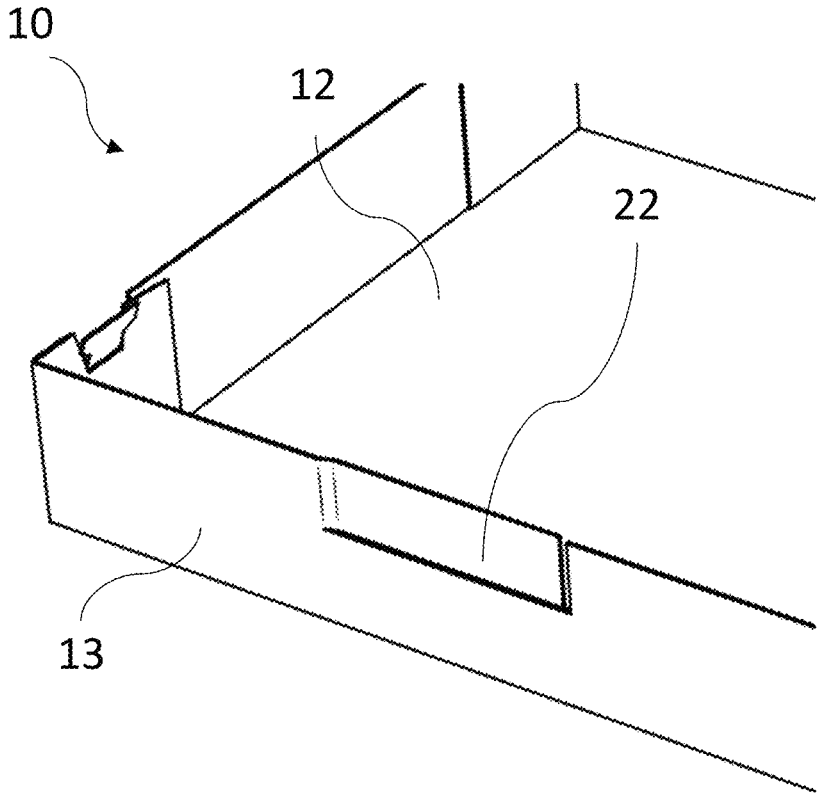
FIG. 6 shows details of a flap of a receiving section as in FIG. 5.
Figure 7:
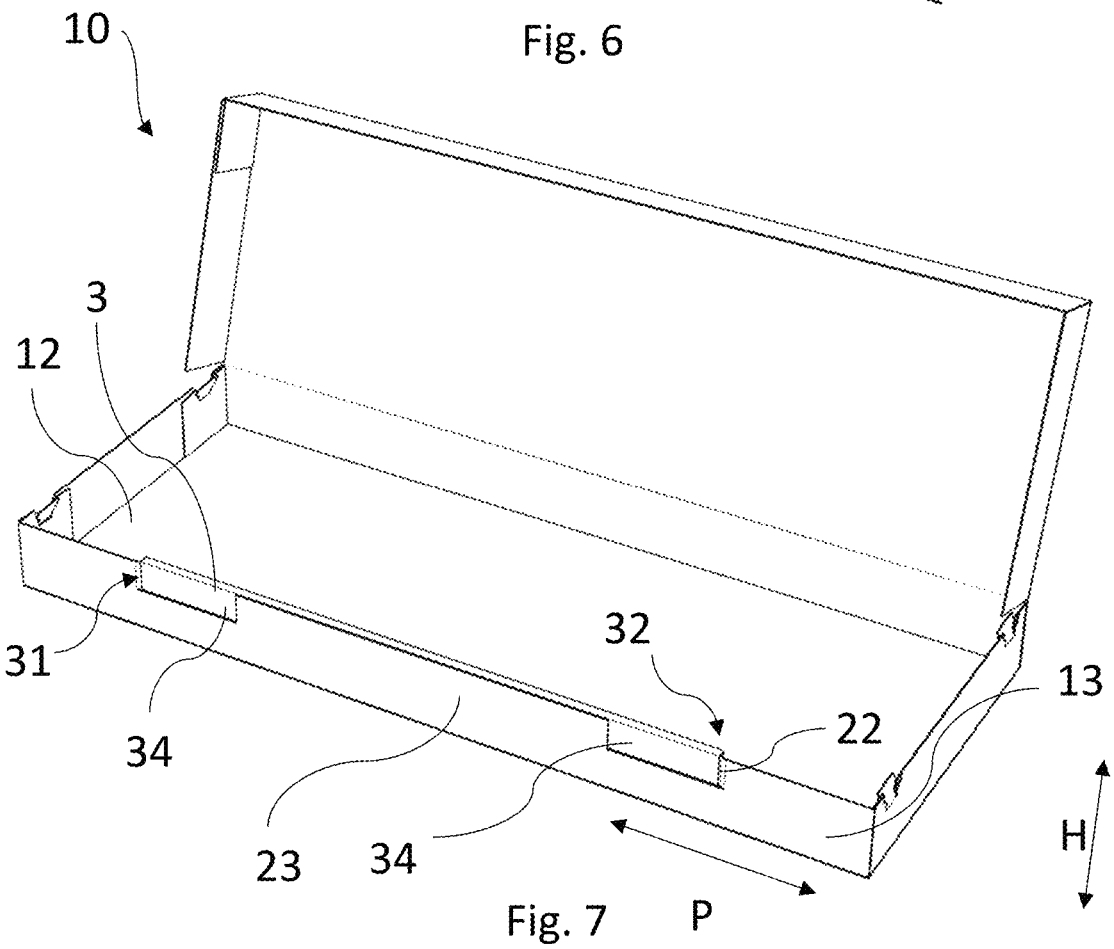
FIG. 7 shows the box of FIG. 5 with a gutter-drain suspended by its longitudinal ends from the flaps in the side wall.

Referring now to FIGS. 5 to 7 which show embodiments of a box 10 with a receiving section 20 having two flaps 22. In FIG. 7 a gutter element 3 is suspended by its longitudinal ends 31, 32 from the flaps 22. The flaps 22 here have a rectangular geometry but could in an alternative embodiment be tapered. The flaps 22 are hinged along the height axis H allowing them to be rotated or deformed about the height axis. Both flaps 22 have been made by cutting the first side wall 13. In alternative designs the side wall may comprise cuts or perforations corresponding to two or more flaps, which would allow a single box blank to the be used for different component collections, by selecting the appropriate flap for a given component. Perforations (not shown) will allow a flap to be used to be easily separated from the side wall, while flaps not be used can left as part of the side wall. FIG. 6 shows details of a flap 22 in a box of corrugated cardboard, which flap has been deformed to a retracted position in relation to the first side wall 13. The flaps 22 can be inserted into a longitudinal end 31 of the gutter element 3, whereby the gutter drain element 10 is suspended from the flaps 22 by its longitudinal ends 31, 32 as shown in FIG. 7. As can be seen the flaps 22 prevents the gutter element 3 from sliding along the first side wall 13 along the primary axis P as it is prevented from moving by the hinged ends of the flaps. The flaps 22 thus efficiently fixate the gutter element in the supply condition while the user can easily retrieve the gutter element by lifting it off the flaps or pulling it away from the side wall.

The two flaps 22 delimit an intermediate section 23 of the first side wall 13. The intermediate portion 23 covers a majority of the gutter element 3, leaving only parts 34 at the ends of the gutter element 3 exposed when seen from the outer side of the box. These exposed parts embodies the first part(s) described above.

As the flaps 22 are integrated in the first side wall 13, the user only needs to recycle the box 10 itself, dramatically increasing the probability that it will be recycled compared to separate fastening members which should be collected and possibly sorted.

Figure 8:
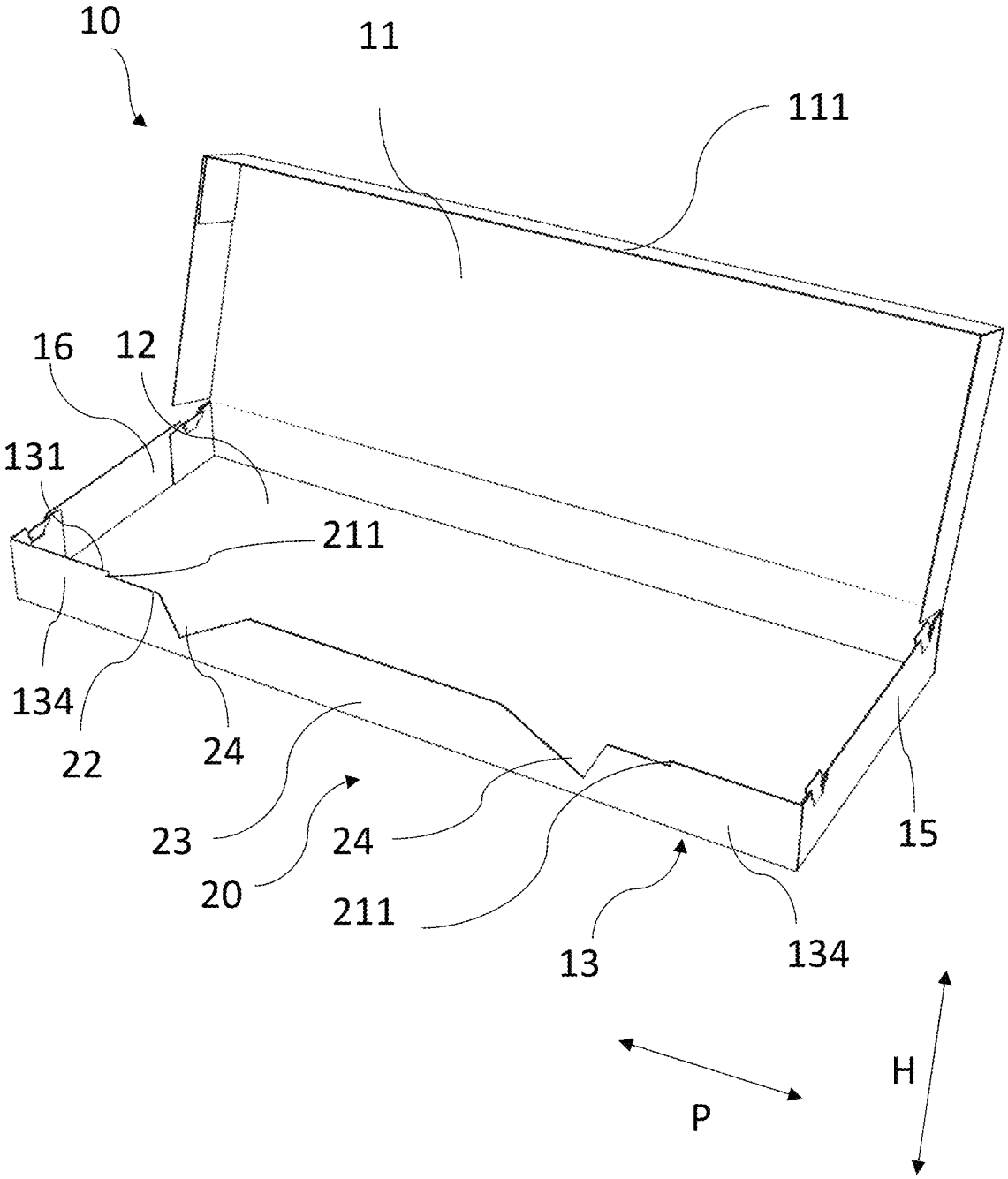
FIGS. 8 to 10 show perspective views of another box which has a receiving section comprises a recess and two cuts, with and without a gutter drain.
Figure 9:
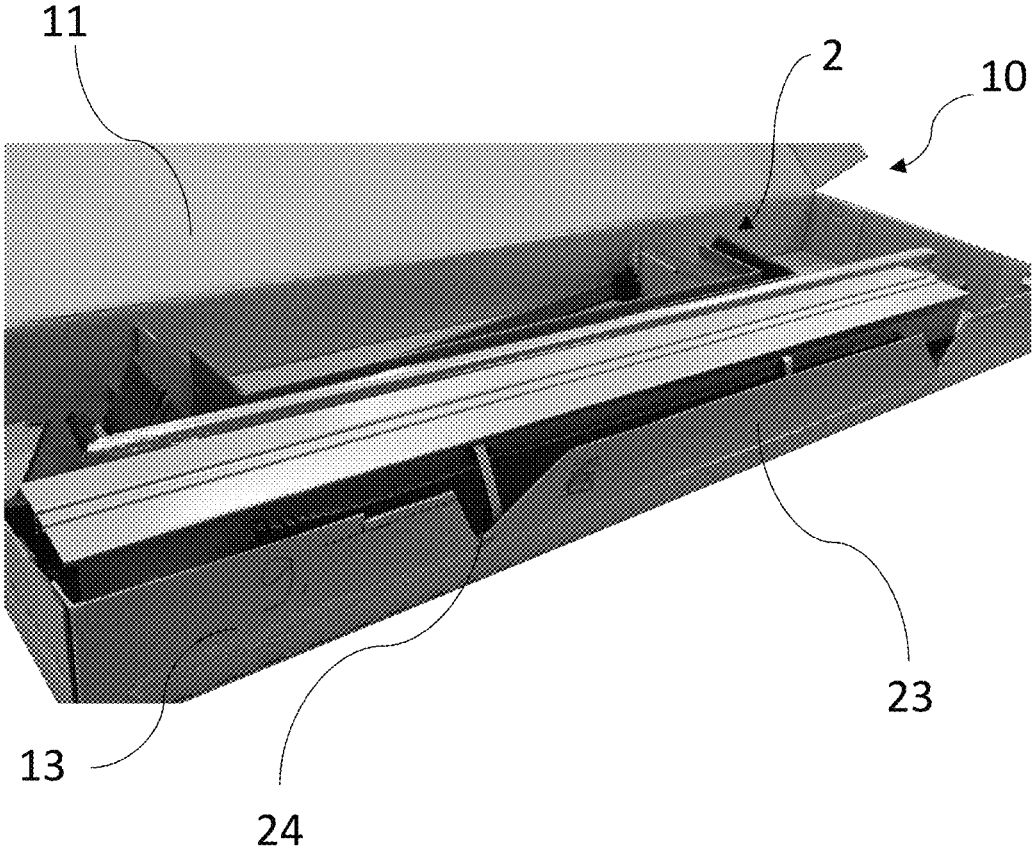
Figure 10:
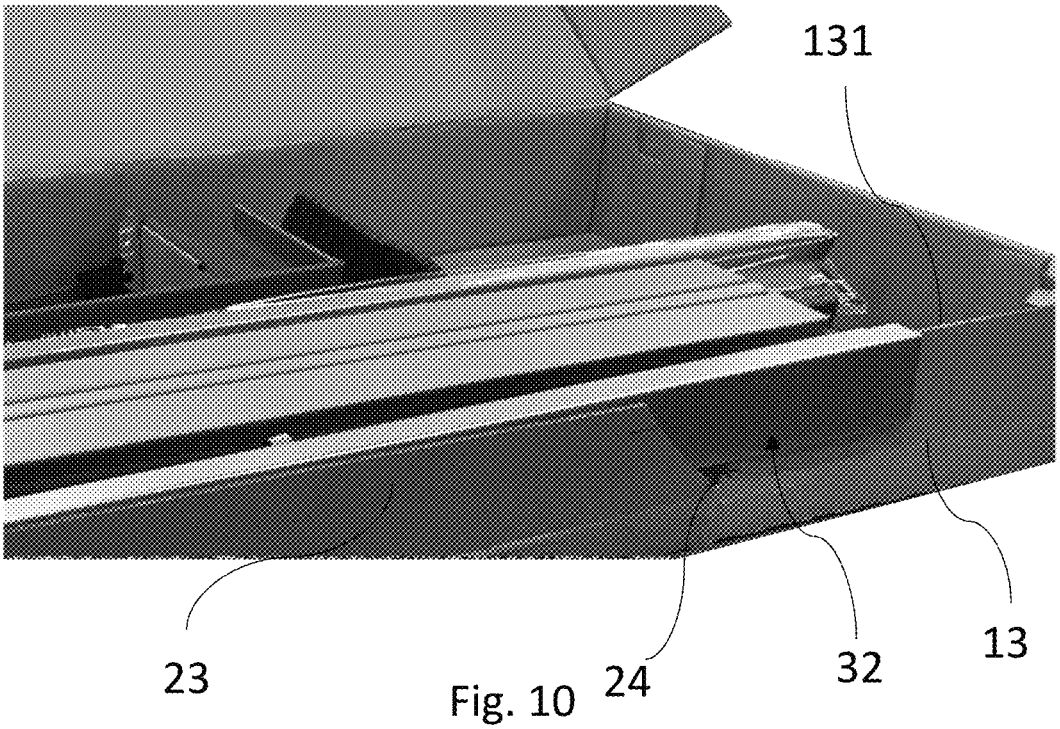

Referring now to FIGS. 8 to 10 which show a box having a receiving section 20 comprising two cuts 24, which are made in the first side wall 13 providing triangular cut-outs and which are spaced apart along the primary axis P. The receiving section 20 thus comprises a two triangular shapes and a recess 22 with recess ends 211. A component can thus be suspended from the two end sections 134 of the first side wall 13, which end sections 134 extend from the cuts 24 to the minor side walls 15, 16 by the upper edges 131 of the end section or suspended from the from the recess 22. In some embodiments a lower edge of the component may be supported by an edge of the cut 24. FIG. 9 shows a cardboard box 10 of the type shown in FIG. 8, where a plurality of components 2 are accommodated in the internal space of the box 10. FIG. 10 shows details of a gutter element 3 suspended from the upper edge 131 of the end sections 134. Similarly, to the embodiment of FIG. 7, the area of the first part 34 of the gutter element 3, i.e. the parts exposed when seen from the outer side, is reduced.

Figure 11:
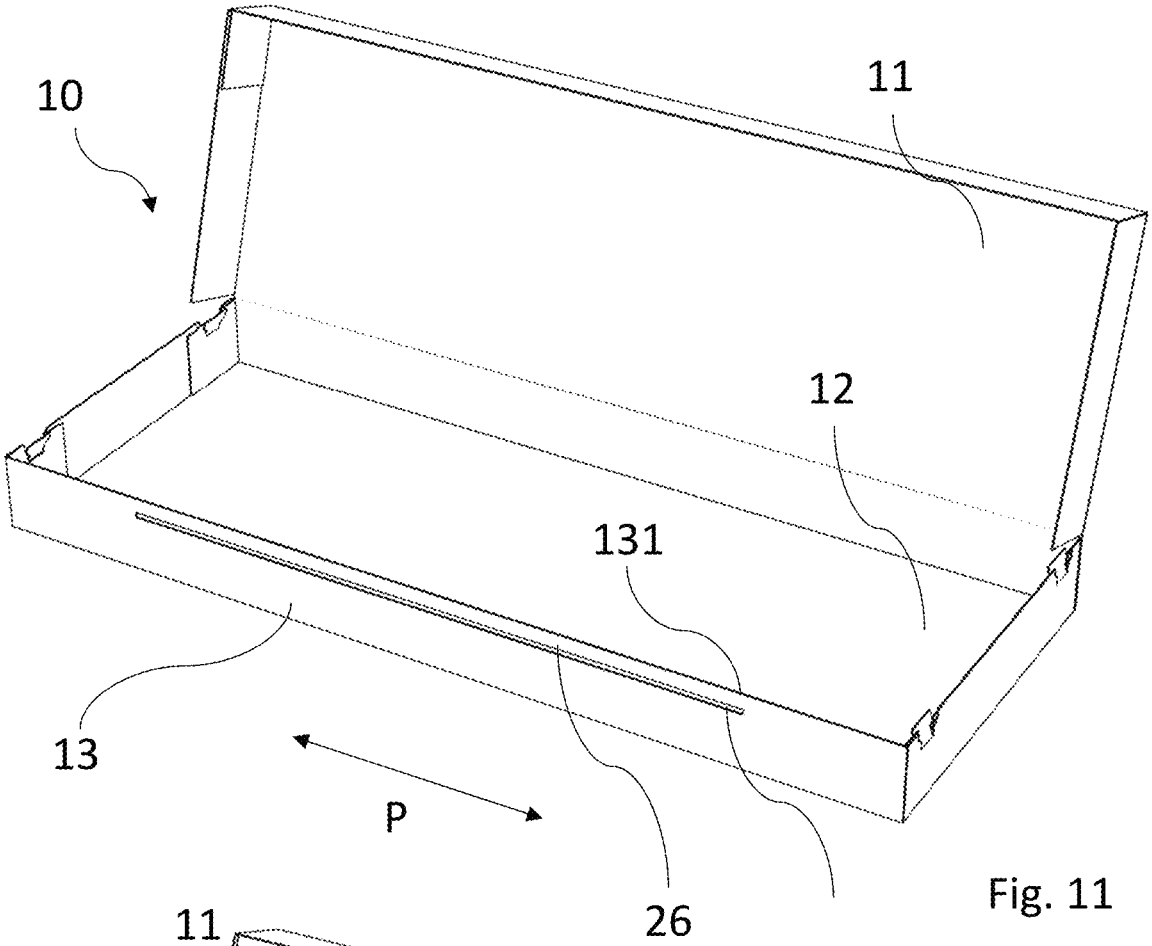
FIG. 11-12 show perspective views of another box with an aperture as a receiving section, without and with a gutter drain.
Figure 12:
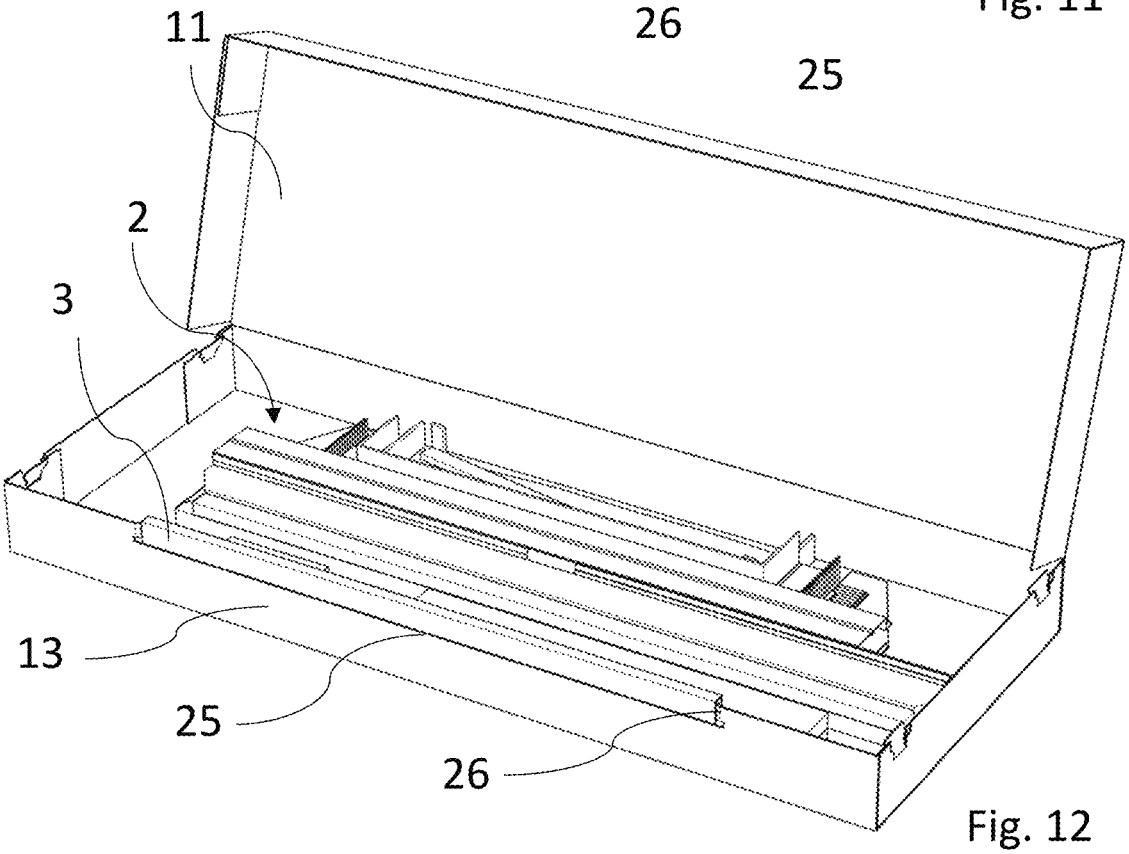

Referring now FIGS. 11 and 12 which show a box 10 with a receiving section comprising an aperture 25 extending along the upper edge 131 of the first side wall 13, without and with a gutter element 3 suspended from the receiving section, respectively. The aperture 25 extends along the primary axis P along part of the first side wall 13 and provides a support section 26. The gutter element 3 is suspended from the support section 26 and extends through the aperture 25 from the outer side of the first side wall 13, preventing the gutter element 3 from any substantial sliding along the side wall. When box is closed to provide the supply condition, the lid 11 and overlap panel (not visible in FIGS. 11 and 12) will cover the gutter element 3 so that it will be locked in place.

Figure 13:
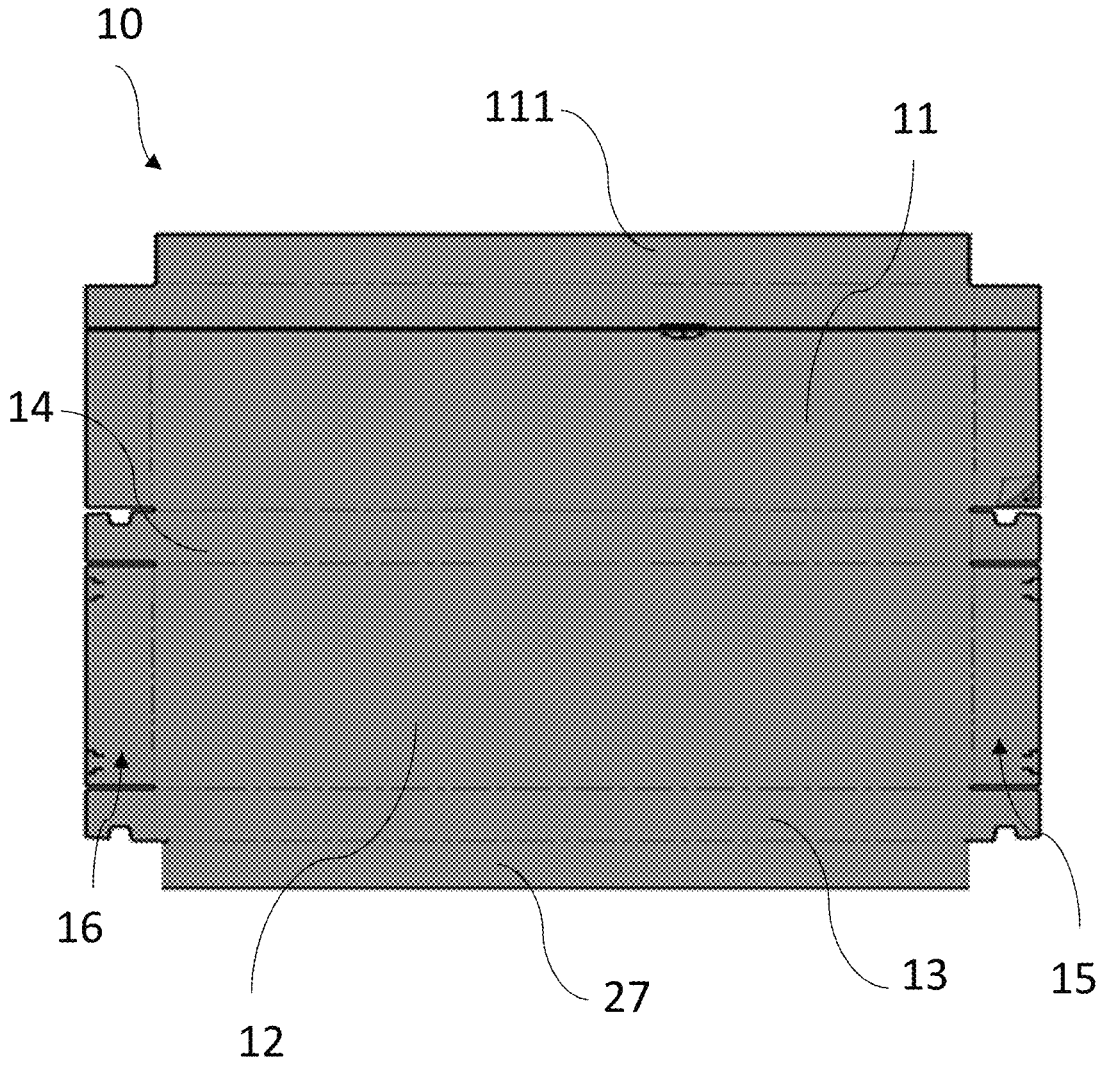
FIG. 13 shows a blank for a box having an inwardly projecting panel.

Referring now to FIGS. 13 to 17 showing embodiments where the first side wall 13 comprises and inwardly projecting panel 27. FIG. 13 shows a blank of the box 10, where the inwardly projecting panel 27 is shown at the first side wall 13 without modifications for receiving a component.

Figure 14:
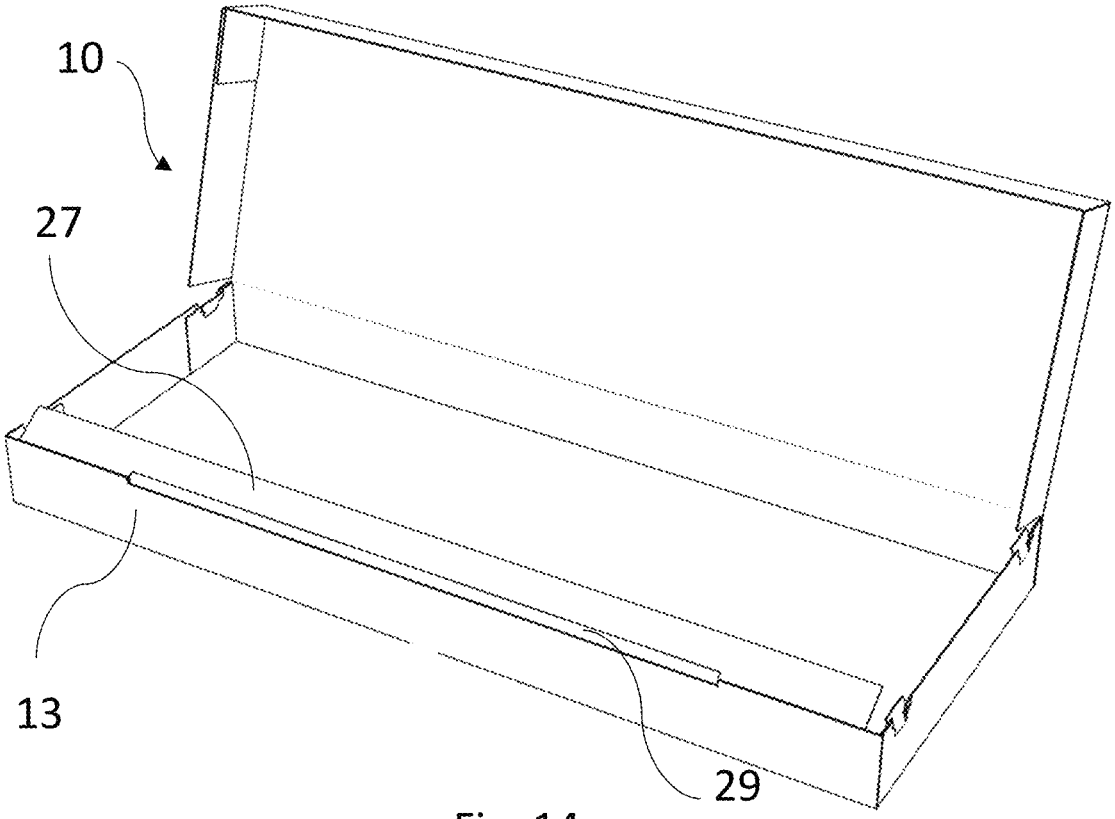
FIG. 14 shows a box having an inwardly projecting panel.
Figure 15:
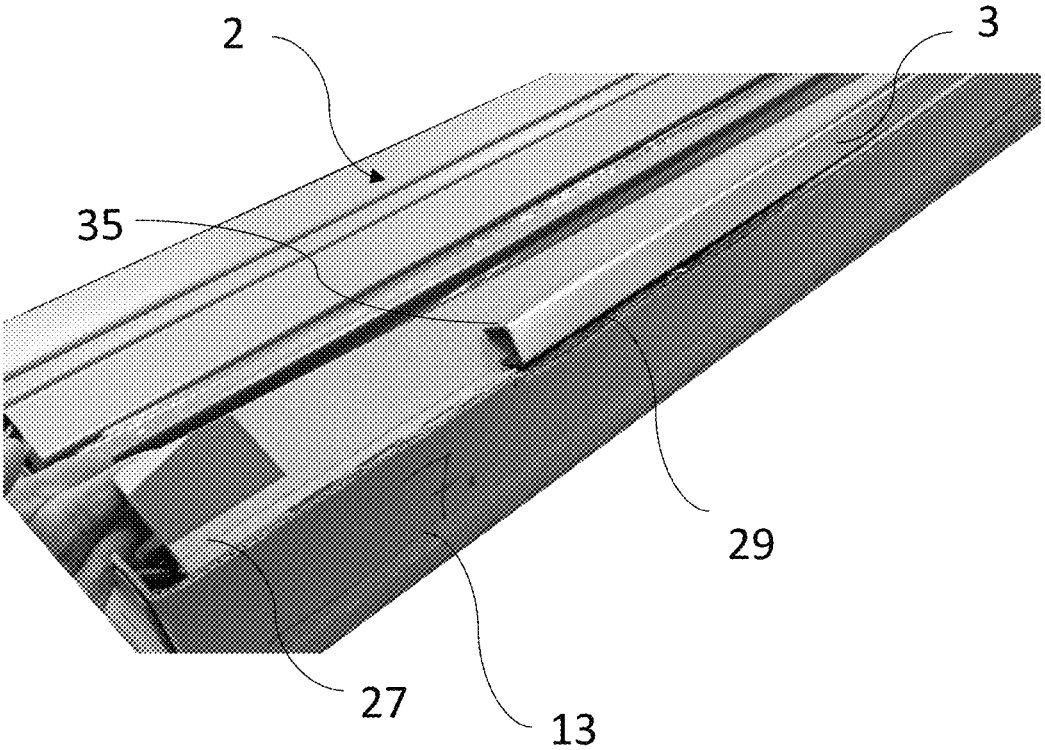
FIG. 15 shows a gutter-drain being suspended from the inwardly projecting panel in FIG. 14.

FIGS. 13 and 14 show an embodiment where an aperture 29 is provided at the inwardly projecting panel 27. The gutter element 3 is suspended from the inwardly projecting panel 27 by extending through the aperture and a leg 35 of the gutter element 3 engages a surface of the inwardly projecting panel facing the internal space of the box, as shown in FIG. 15. In the supply condition the lid 11 will engage the gutter element which combined with the aperture 29 will lock in gutter element 3 in place.

Figure 16:
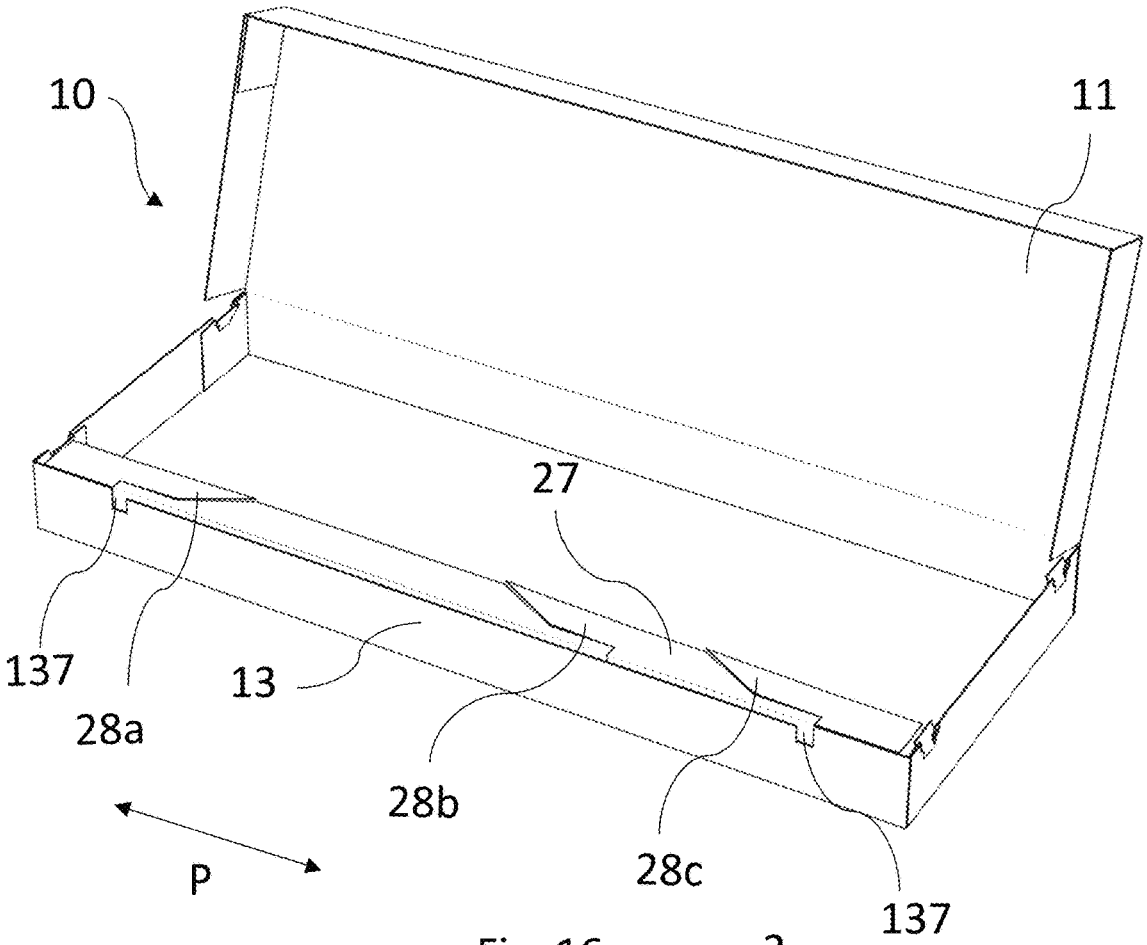
FIG. 16 shows another box having an inwardly projecting panel.
Figure 17:
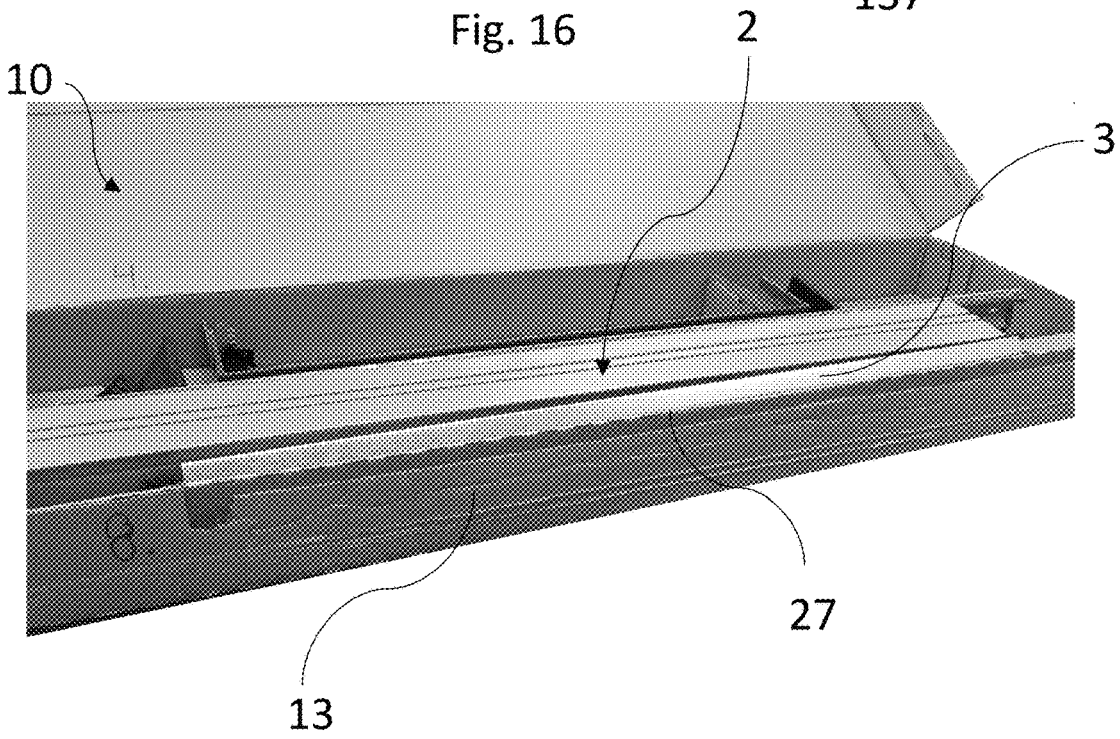
FIG. 17 shows a gutter-element being suspended from the inwardly projecting panel in FIG. 16.

In the embodiment of FIGS. 16 and 17 the inwardly projecting panel 27 is a separate part attached to a box 10 of the type shown in FIG. 2 but having additional recesses 137, but it is to be understood that it might also be attached to another type of box or be provided as an integrated part of the box as shown in FIG. 13. Similar considerations apply to the box in FIG. 13-15.

The inwardly projecting panel 27 in FIGS. 16 and 17 has flaps 28*a*-*c* from which the gutter element 3 can be suspended. The left-hand flap 28*a* and the flaps 28*b*-*c* on the right-hand side project in opposite directions along the primary axis P. The two right hand flaps 28*b*-*c* allow for components of different lengths to be suspended from the internally projecting panel 27 in the manner described with reference to FIGS. 5-7 above.

Figure 18:
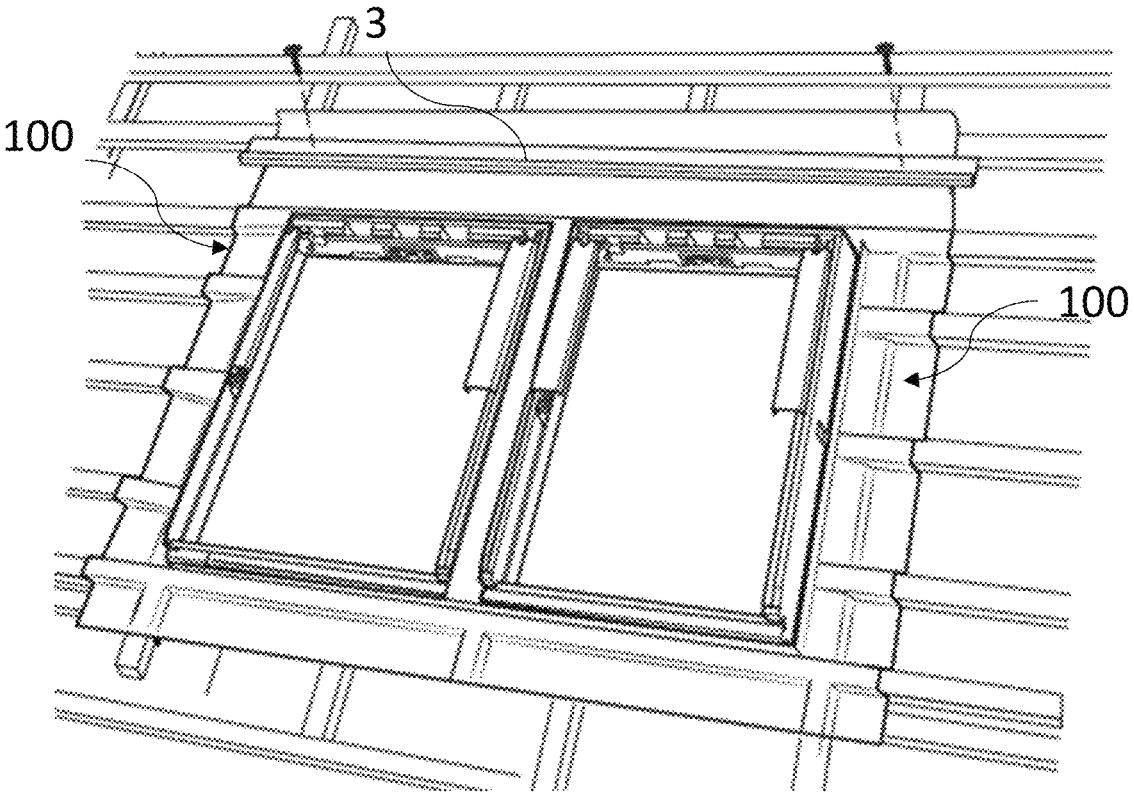
FIGS. 18 to 19 shows the installation of a gutter element and a cover plate, respectively, at a pair of roof windows.
Figure 19:
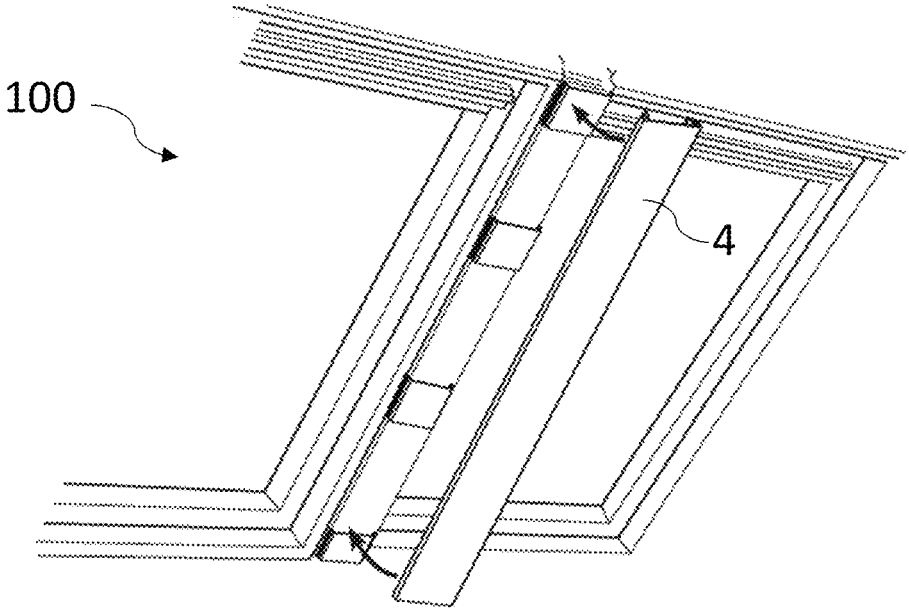

Referring now to FIGS. 18 and 19 which show a gutter element 3 and a cover plate 4 being installed with a roof window 100, the gutter element 3 and 10 the cover plate 4 are exemplary embodiments of components suitable for being suspended from the first side wall 13 as described above. Other components having a cross-sectional shape comprising at least two legs extending at an angle to each other may potentially also be suspended from the first side wall.

LIST OF REFERENCE NUMERALS

1 Packed roof window product
2 Window product related components
3 Gutter element
31 Longitudinal end
32 Longitudinal end
35 Leg
34 First part
4 Cover
10 Box
11 Top side, Lid
111 Overlap panel
112 Zone of reduced thickness
12 Bottom side
13 First side wall
131 Upper edge
134 End section
14 Side wall
15 Side wall
16 Side wall
20 Receiving section
21 Recess
211 Recess end
22 Flaps
23 Intermediate section
24 Cut
25 Aperture
26 Support section
27 Internally projecting panel
28*a*-*c* Flaps
29 Aperture
40 String of glue
100 Window
D Depth
H Height axis
L Length of first side wall
RL Recess length
P Primary axis
S Secondary axis

The invention claimed is:

1. A packed roof window product comprising a plurality of components accommodated in a box, wherein the plurality of components includes differently sized roof window related product components, wherein the box in a supply condition has a bottom side and a top side, which bottom side and top side are spaced apart along a height axis, and side walls of the box extend between the bottom side and top side of the box in the height axis, said bottom side, top side and side walls delimiting an internal space of the box, and wherein a first side wall extends in a primary axis, which primary axis is perpendicular to the height axis, and said first side wall has an upper edge extending along the primary axis along the top side and an outer surface facing away from the internal space, a first component of said plurality of components is carried by the upper edge of the first side wall.

2. The packed roof window product according to claim 1, wherein the first side wall comprises a receiving section, and wherein the first component is carried by the receiving section.

3. The packed roof window product according to claim 2, wherein the receiving section comprises a recess in the upper edge of the first side wall.

4. The packed roof window product according to claim 2, wherein the receiving section comprises an aperture in the first side wall.

5. The packed roof window product according to claim 4, wherein the aperture extends along the primary axis, defining a support section of the first side wall between the upper edge and the aperture, wherein the first component is carried by the support section.

6. The packed roof window product according to claim 1, wherein the first component is elongate and has a component length extending between longitudinal ends of the first component, and the first component is carried by the first side wall by being suspended at the longitudinal ends of the first component.

7. The packed roof window product according to claim 2, wherein the receiving section comprises at least two flaps and the first component is carried by the first side wall by being suspended from the at least two flaps at the longitudinal ends of the first component.

8. The packed roof window product according to claim 2, wherein the receiving section comprises at least two cuts in the first side wall from the upper edge, which two cuts are spaced apart along the primary axis.

9. The packed roof window product according to claim 1, wherein the first side wall of the box comprises an inwardly projecting panel projecting into the internal space of the box, and the first component is carried by the first side wall by being suspended from the inwardly projecting panel.

10. The packed roof window product according to claim 1, wherein the first component comprises two legs extending at an angle to each other, and the first component is suspended by one of the two legs.

11. The packed roof window product according to claim 1, wherein the first side wall has a length L along the primary axis and the first component extends over 20 to 90% of the length L.

12. The packed roof window product according to claim 1, wherein the box is made from a cardboard.

13. The packed roof window product according to claim 12, wherein the cardboard box is folded from one or more blanks.

14. The packed roof window product according to claim 12, wherein the cardboard box is folded from a blank of the five-panel fold type or a blank of the telescopic type.

15. The packed roof window product according to claim 1, wherein the first side wall has a length L along the primary axis and the first component extends over 50 to 90% of the length L.

16. A packed roof window product comprising a plurality of components accommodated in a box, wherein the plurality of components includes differently sized roof window related product components, wherein the box in a supply condition has a bottom side and a top side, which bottom side and top side are spaced apart along a height axis, and side walls of the box extend between the bottom side and top side of the box in the height axis, said bottom side, top side and side walls delimiting an internal space of the box, and wherein a first side wall extends in a primary axis, which primary axis is perpendicular to the height axis, and said first side wall has an upper edge extending along the primary axis along the top side and an outer surface facing away from the internal space, a first component of said plurality of components is carried by the first side wall, wherein a first part of the first component overlaps with the outer surface of the first side wall.

17. The packed roof window product according to claim 16, wherein the top side of the box is formed by a lid of the box, the lid comprising an overlap panel, which overlap panel overlaps the outer surface of the first side wall in the supply condition, so that the first part of the first component is located between the first side wall and the overlap panel.

18. The packed roof window product according to claim 17, wherein the overlap panel and/or the first side wall is provided with a zone of reduced thickness, and wherein this zone corresponds in size and shape at least to the first part of the first component.

19. A packed roof window product comprising a plurality of components accommodated in a box, wherein the plurality of components includes differently sized roof window related product components, wherein the box in a supply condition has a bottom side and a top side, which bottom side and top side are spaced apart along a height axis, and side walls of the box extend between the bottom side and top side of the box in the height axis, said bottom side, top side and side walls delimiting an internal space of the box, and wherein a first side wall extends in a primary axis, which primary axis is perpendicular to the height axis, and said first side wall has an upper edge extending along the primary axis along the top side and an outer surface facing away from the internal space, a first component of said plurality of components is carried by the first side wall, wherein the first component is a gutter-shape component of a covering assembly or a flashing assembly for a roof window.

* * * * *